US009142894B2

(12) United States Patent
Barezzani

(10) Patent No.: US 9,142,894 B2
(45) Date of Patent: Sep. 22, 2015

(54) PERMANENT ELECTRICAL CONTACT APPLICABLE TO THE WEB OF RAILS AND THE LIKE

(71) Applicant: Cembre S.p.A., Brescia (IT)

(72) Inventor: Gualtiero Barezzani, Concesio (IT)

(73) Assignee: Cembre S.p.A., Brescia (IT)

( * ) Notice: Subject to any disclaimer, the term of this patent is extended or adjusted under 35 U.S.C. 154(b) by 260 days.

(21) Appl. No.: 13/801,989

(22) Filed: Mar. 13, 2013

(65) Prior Publication Data

US 2013/0240264 A1 Sep. 19, 2013

(30) Foreign Application Priority Data

Mar. 15, 2012 (IT) ..... MI2012A0406

(51) Int. Cl.

| | |
|---|---|
| ***H01R 4/64*** | (2006.01) |
| ***H01R 4/06*** | (2006.01) |
| ***H01R 4/62*** | (2006.01) |
| ***B21D 19/08*** | (2006.01) |
| ***B21D 39/08*** | (2006.01) |
| ***B21J 15/04*** | (2006.01) |
| ***B21K 1/60*** | (2006.01) |
| *H01R 43/16* | (2006.01) |

(52) U.S. Cl.

CPC *H01R 4/64* (2013.01); *B21D 19/08* (2013.01); *B21D 39/08* (2013.01); *B21J 15/04* (2013.01); *B21J 15/043* (2013.01); *B21K 1/60* (2013.01); *H01R 4/06* (2013.01); *H01R 4/62* (2013.01); *H01R 43/16* (2013.01)

(58) Field of Classification Search

USPC ..... 361/807, 809, 810, 799

See application file for complete search history.

(56) References Cited

U.S. PATENT DOCUMENTS

| | | | | |
|---|---|---|---|---|
| 3,835,615 | A * | 9/1974 | King, Jr. | 403/408.1 |
| 4,007,659 | A * | 2/1977 | Stencel | 411/34 |
| 4,433,567 | A * | 2/1984 | Mead | 72/342.7 |
| 5,129,253 | A * | 7/1992 | Austin et al. | 72/370.07 |
| 5,238,342 | A * | 8/1993 | Stencel | 411/43 |
| 5,743,015 | A * | 4/1998 | Kunze et al. | 29/898.07 |
| 2012/0246930 | A1 * | 10/2012 | Woolley et al. | 29/874 |

FOREIGN PATENT DOCUMENTS

| | | |
|---|---|---|
| EP | 0 793 294 A2 | 9/1997 |
| EP | 0 945 919 A1 | 9/1999 |
| GB | 1 430 362 | 3/1976 |

* cited by examiner

*Primary Examiner* — Hung S Bui

(74) *Attorney, Agent, or Firm* — Dickstein Shapiro LLP

(57) ABSTRACT

A permanent electrical contact applicable to the web of rails. The contact comprises a bush in electrically conductive material having a tubular stem suitable for inserting in a hole in the web of a rail, a flanged head radially widened compared to the stem and suitable for engaging in abutment with a portion surrounding the hole, and an axial through hole in which a punch can be inserted to expand the tubular stem radially and join a radially outer surface of the stem closely with the hole. At least a portion of the outer surface of the stem is substantially made of a first conductive metal and at least a portion of the flanged head is substantially made of a second conductive metal different from the first conductive metal.

11 Claims, 4 Drawing Sheets

PERMANENT ELECTRICAL CONTACT APPLICABLE TO THE WEB OF RAILS AND THE LIKE

BACKGROUND OF THE INVENTION

1. Field of the Invention

The present invention relates to a permanent electrical contact applicable to the web or flange of rails and the like.

2. Description of the Related Art

As known, permanent electrical contacts for the electrical connection of sections of rail are required to have contact characteristics which reduce contact resistances and need to be structurally simple and robust. To such purpose, it is known to make permanent electrical contacts applicable to the web of a rail, by means of a bush in electrically conductive material having a cylindrical stem insertable in a hole made in the web of the rail and a flanged head suitable for engaging in abutment with the portion of rail surrounding the hole, wherein the bush has an axial through hole into which a punch can be inserted to generate a radial expansion of the cylindrical stem against the hole in the rail. Given its excellent mechanical characteristics (plastic deformation capacity and close engagement with the inner surface of the hole during the drawing of the material by means of the punch, elevated mechanical resistance and toughness) and electrical characteristics (high electric conductivity and electrogalvanic compatibility with steel), as well as its high resistance to corrosion, copper has up to today been the natural choice for making the contact bushes.

However, on account of the significant increase in the cost of copper and consequent frequent theft of conductors made from such metal, over recent years the use of electric conductors and connectors (so-called cable terminals) in aluminium has increased, the use of which however entails exposure to the environment of metals with different galvanic potential, such as copper and aluminium, with consequent risks of interstitial galvanic corrosion in the contact area between the aluminium connector and the contact bush in copper.

In order to overcome the problem of galvanic corrosion which could occur in the contact area between the aluminium and the copper, bi-metal connectors are currently sold on the market having a hollow seat in aluminium suitable for being compressed onto the conductor, as well as a terminal connection portion made of copper suitable for being connected in contact with a terminal, in which the hollow seat and the terminal connection portion are welded to each other.

Such solution, while resolving the problem of interstitial corrosion of the cable terminal in a satisfactory manner, is not without drawbacks. The manufacturing process of the single parts in aluminium and copper and their subsequent joining by welding is, on the one hand, complex and costly and, on the other, is not able to obtain a sufficiently reliable and resistant copper-aluminium connection for applications in which the connectors are subject to vibrations.

SUMMARY OF THE INVENTION

The purpose of the present invention is therefore that of proposing a permanent electrical contact applicable to the web or flange of rails and the like, having characteristics such as to obviate at least some of the drawbacks mentioned in relation to the prior art.

One particular purpose of the invention is to reconcile the need for a close and resistant union of the electrical contact with the web of the rail with the need to be able to use the contact with a cable terminal in a conductor material other than copper (e.g. aluminium) and with the need to use conductor materials having different galvanic potential.

These and other purposes are achieved by means of a permanent electrical contact applicable to the web of rails and the like, comprising a bush in electrically conductive material having a tubular stem suitable for inserting in a hole made in the web of a rail, a flanged head suitable for engaging in abutment with a portion surrounding the hole, and an axial through hole in which a punch can be inserted to expand the tubular stem radially and join a radially outer surface of the stem closely with the hole, wherein the outer surface of the tubular stem is substantially made of a first conductive metal and at least a portion of the flanged head is substantially made of a second conductive metal different from the first conductive metal.

According to one aspect of the invention, the flanged head forms a frontal contact surface on a side opposite the stem side (and facing away from the rail), the front contact surface being made substantially from the second conductive metal. For example the radially outermost surface of the stem may be made substantially from copper and the flanged head portion, especially the front contact surface, may be made substantially from aluminium.

According to one aspect of the invention, the bush is composed of a multilayer tubular body having an outer layer substantially made from the first conductive metal and an inner layer substantially made from the second conductive metal. The inner layer and the outer layer are connected to one another with a continuity of material substantially on the entire surface or, in other words, on the interface between the two layers.

The connection between the two layers can be made by through melting of the material in the transition area between the outer layer and the inner layer, for example through a manufacturing step of the double layer or multilayer tubular body through drawing or co-extrusion.

The contact bush and permanent electrical contact thus configured make it possible to obtain the specific advantages of a bi-metal contact (no difference of galvanic potential in the area of contact between the cable terminal and the terminal) with low costs and with mechanical resistance suitable for applications subject to strong vibrations.

Moreover, the use of a contact bush consisting of a multilayer tubular body manufactured through drawing or co-extrusion and subsequent definitive shaping allows a production of the bush and of the permanent electrical contact on a large scale with low costs and with a close and resistant joining between the layers themselves.

In the present description the terms "substantially made of a first metal" and "substantially made of a second metal" or more specifically, "substantially made of copper" and "substantially made of aluminium" do not exclude alloys of such metals as long as the metals indicated form the main portion of the alloy itself. In the preferred embodiment, the expressions "substantially made of copper" and "substantially made of aluminium" refer to the two metals as usually found on the market and used as conductors for the electrical and electrotechnical industry.

BRIEF DESCRIPTION OF THE DRAWINGS

For a clearer comprehension of the invention and to appreciate the advantages thereof, some of its embodiments will be described below, made by way of a non-limiting example, with reference to the attached figures, wherein.

DETAILED DESCRIPTION OF THE PREFERRED EMBODIMENTS

Figure 1:
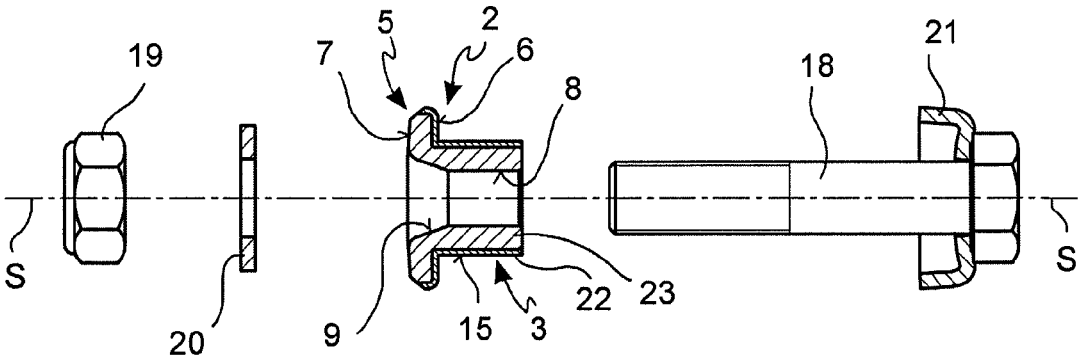
FIG. 1 is an exploded view, partially in cross-section of a permanent electrical contact according to one embodiment.

With reference to the figures, a permanent electrical contact applicable to the web 1 of a rail or the like comprises a contact bush 2 which is made from electrically conductive material and has a tubular stem 3, possibly cylindrical, suitable for inserting in a hole 4 made on the web 1 or flange of a rail. The stem 3 projects and extends in an axial direction S from a flange-shaped head 5 of the bush 2.

The flange-shaped head 5 is radially widened in relation to the stem 3 and forms an abutment surface 6 facing in the direction of the stem 3 and suitable for abutting against the portion of the web 1 which surrounds the hole 4, when the stem 3 is inserted in the hole 4. The head 5 of the bush 2 forms in addition a front contact surface 7 opposite the abutment surface 6 and facing away from the stem 3.

The bush 2 forms an axial through hole 8 having a widening 9 at the head 5 for the introduction of a lubricant substance and to prevent unwanted deformations of the head 5 during an expansion phase of the bush 2 in the hole 4 which will be described below.

The permanent blocking of the contact bush 2 to the web 1 of the rail is obtained by means of a calibrated punch 10 which has a truncated cone shaped widening portion 11 connected to a shaft 12 having a threaded end 13. After inserting the bush 2 in the hole 4 of the rail the calibrated punch 10 is inserted from the side of the head 5 in the through hole 8, making the threaded end 13 come out from the other end of the through hole 8 on the side of the stem 3.

By means of a pulling mechanism 14, such as a hydrodynamic jack, the threaded end 13 of the punch 10 is engaged on the side of the rail opposite that against which the head 5 of the bush 2 abuts, and a mechanical pulling of the punch 10 is performed. The punch 10 moves axially through the through hole 8 of the bush 2, widening the latter radially against the hole 4 and thus obtaining a stable and close contact between a radially outer surface 15 of the stem 3 and the surface of the hole 4.

The material plastically deformed and moved by the calibrated punch 10, in excess to that needed to fill the hole 4, undergoes a drawing in an axial direction S which leads to an extension of the free end of the stem 3 outside of the hole 4 and radially outwards on the side of the rail opposite that against which the flanged head 5 abuts. This creates a further attachment portion of the deformed bush 2 on the rail.

Figure 2:
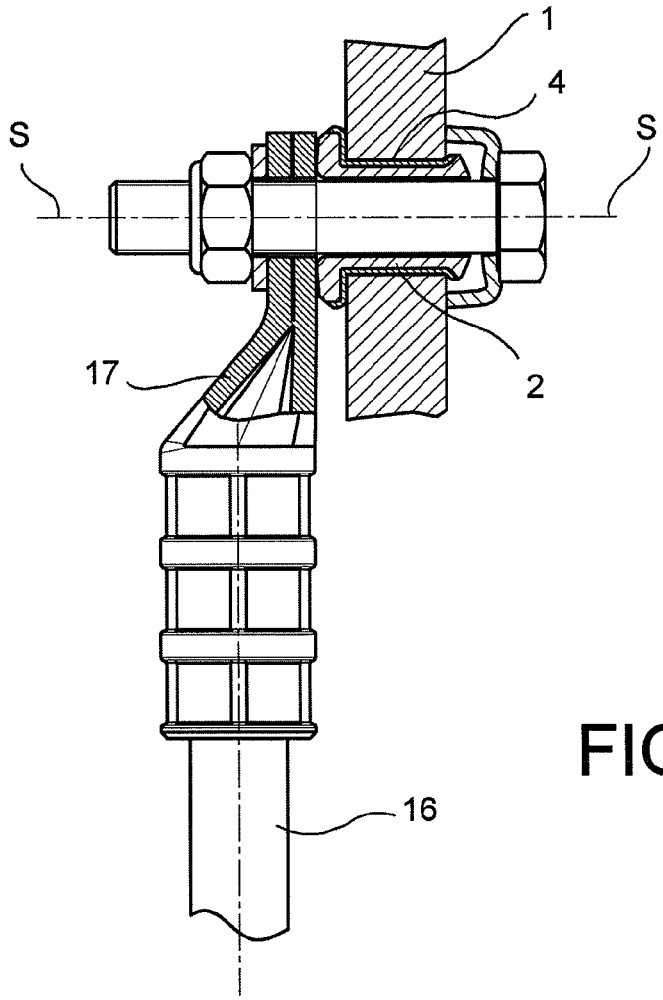
FIG. 2 is a cross-section view of the permanent electrical contact in FIG. 1 applied to the web of a rail, in which an electric cable with a cable terminal is connected to the permanent contact by means of a clamping bolt.
Figure 4:
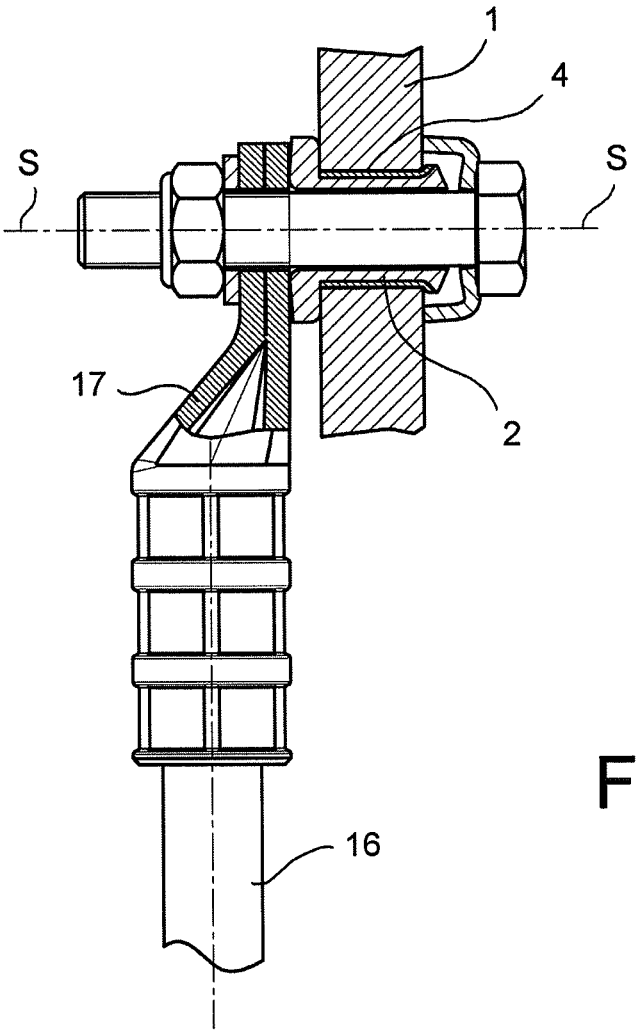
FIG. 4 is a cross-section view of the permanent electrical contact in FIG. 3 applied to the web of a rail, in which an electric cable with a cable terminal is connected to the permanent contact by means of a clamping bolt.
Figure 5:
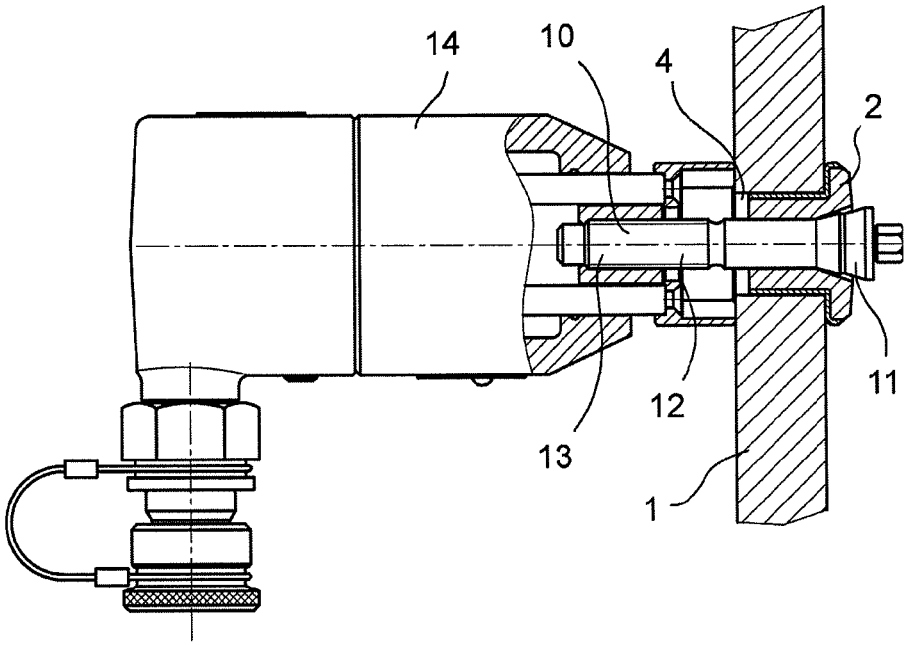
FIGS. 5 and 6 show steps of radial expansion and drawing of a bush of the electrical contact.
Figure 6:
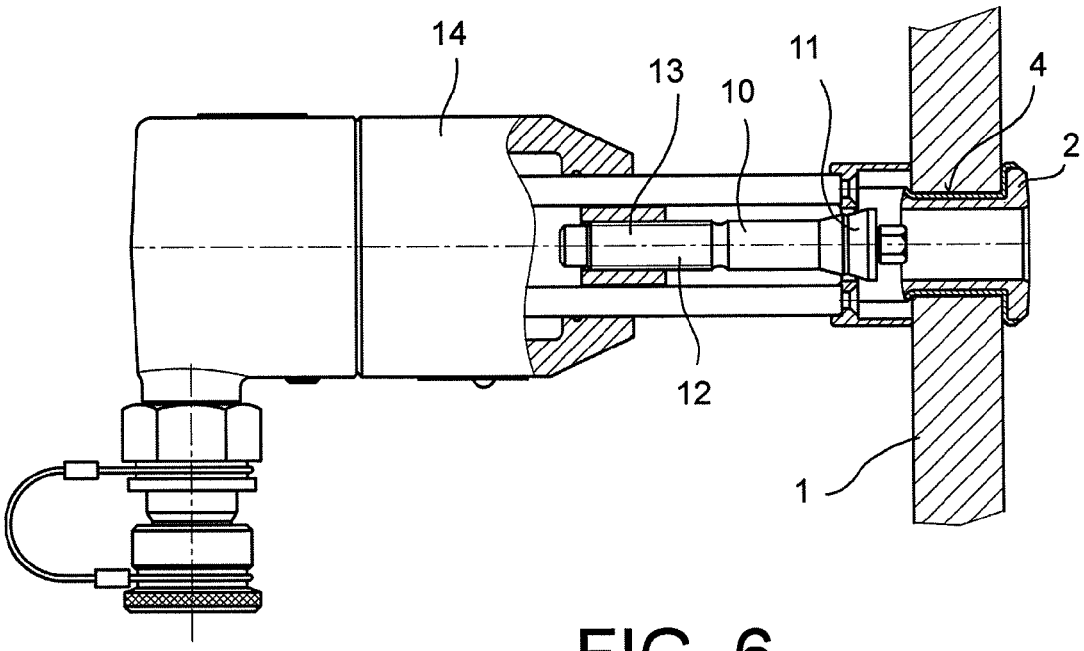
Figure 7:
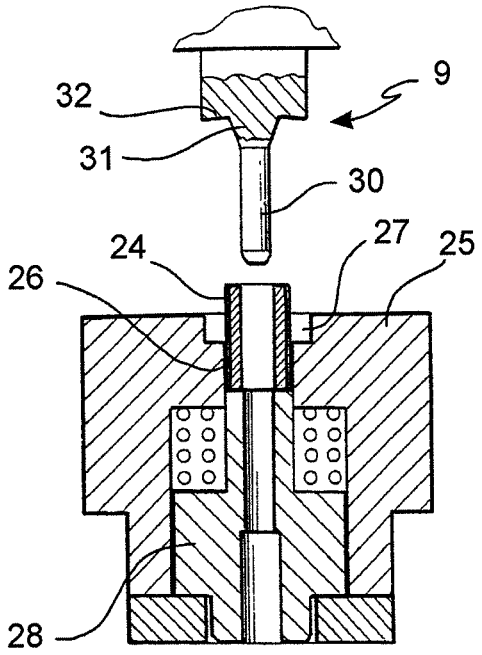
FIG. 7 shows, in cross-section, a step of introducing a section of double layer copper-aluminium tube inside a mould.
Figure 8:
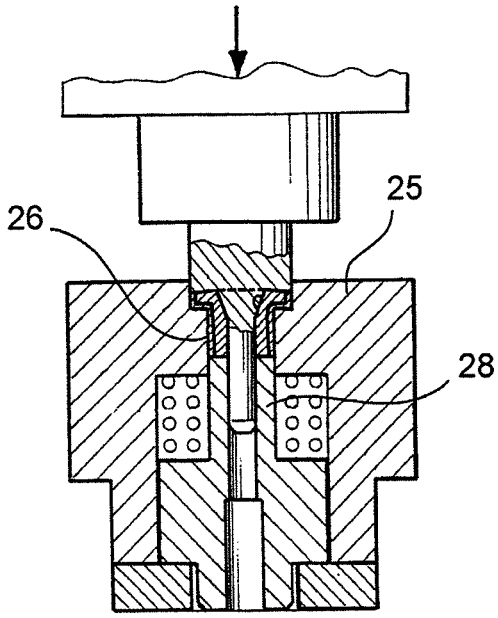
FIG. 8 schematically shows a cold deformation step of the section of double layer tube.
Figure 9:
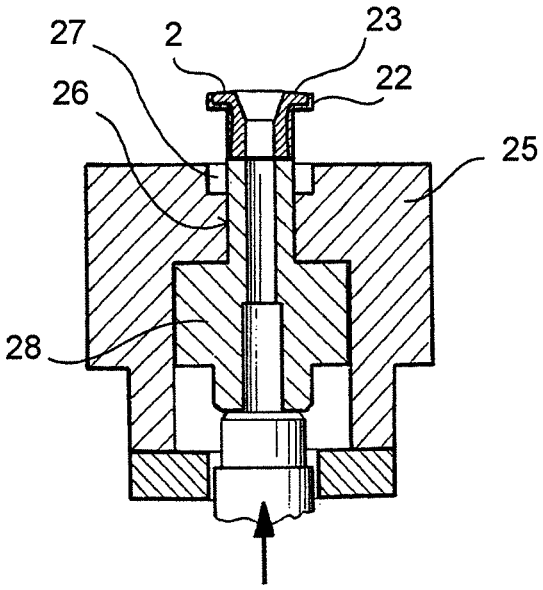
FIG. 9 schematically illustrates an extraction step from the mould of the contact bush made.
Figure 10:
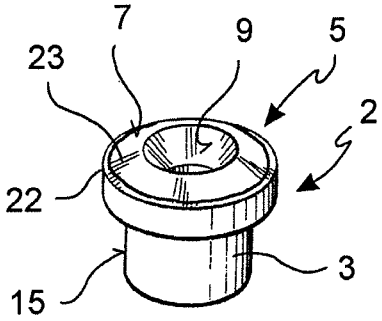
FIG. 10 is a perspective view of the fabricated contact bush.

The radial expansion performed permits a permanent and close electrical contact to be obtained between the bush 2 and the hole 4 of the rail, while the calibrated hole formed inside the bush (widened through hole 8) permits the removable application of electric conductors 16 with cable terminal 17 by means of a bolt 18 (FIGS. 2 and 4) inserted in the calibrated hole (through hole 8 widened by the punch 10) and suitable for being screwed up with a nut 19 to tighten the cable terminal 17 against the contact surface 7 of the flanged head 5 of the bush 2. To such purpose the bolt may be fitted with a first washer 20 positioned between the cable terminal 17 and the nut 19, as well as a second washer 21 with a cavity 24 suitable for receiving the free protruding end of the stem 3 and a rim suitable for abutting directly against the rail to transmit the pressure of the bolt 18 thereto, bypassing the protruding portion of the bush 2.

According to one aspect of the invention, the radially outer surface 15 of the tubular stem 3 is (or comprises at least a portion) substantially made of a first conductive metal (e.g. copper) and at least a portion of the flanged head 5 is substantially made of a second conductive metal (e.g. aluminium) different from the first conductive metal.

In one embodiment, the front contact surface 7 of the flanged head 5 is (or comprises a portion) made substantially from the second conductive metal (e.g. aluminium). This way a permanent bi-metal contact is obtained which overcomes the problems of interstitial galvanic corrosion in the case of use of electric conductors in materials having different galvanic potential and it is therefore possible to use single-material cable terminals in the same material as the electric conductors, such as aluminium.

In one possible embodiment, the bush 2 may be composed of a tubular body made of the second conductive material (such as aluminium) externally coated with a layer of the first conductive material (e.g. copper). Such outer coating may be complete so as to protect the second conductive metal (e.g. aluminium) from unwanted surface corrosion before the application of the permanent contact to the rail. Depending on the thickness of the coating at the contact surface 7 of the head 5, such coating may be subsequently removed or smoothened during the tightening of the bolt 18 to expose the second conductive metal in such area.

Figure 3:
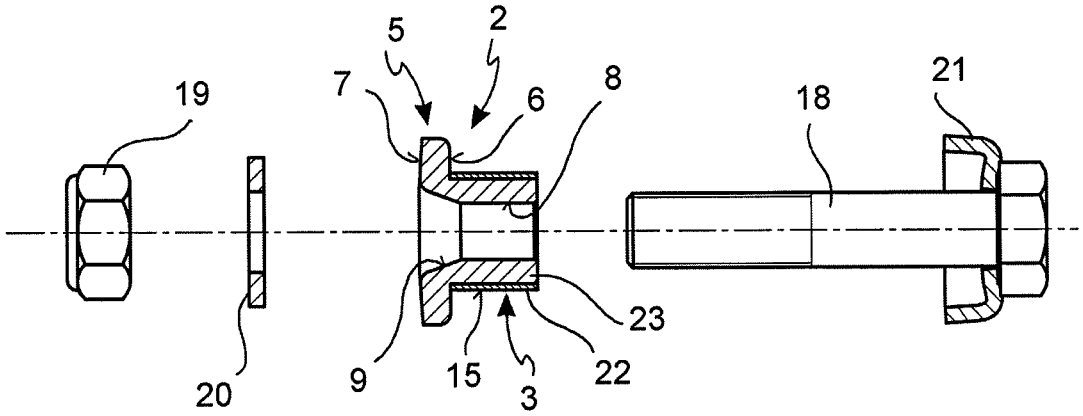
FIG. 3 is an exploded view, partially in cross-section of a permanent electrical contact according to a second embodiment.

According to one embodiment, (FIGS. 3,4) the entire radially outer surface 15 of the stem 3 is made of the first conductive metal (preferably copper) to benefit from the excellent mechanical and electrical characteristics of the first metal in the entire area of interface between the stem 3 and the hole 4 of the rail.

In this embodiment, it is possible to make the entire flanged head 5 of the bush substantially from the second conductive metal (such as aluminium) thereby reducing to a minimum the use of the first metal which, in the case of copper, has a higher cost than the second metal.

In a further embodiment, the abutment surface 6 of the head 5 is made substantially from the first metal (preferably copper) in such a way as to ensure a continuity of the conductivity characteristics and of the coupled materials in the entire interface area between the rail and the contact bush 2.

In order to expose only one material to contact with the cable terminal 17 it may instead be desirable not to extend a layer or coating of the first conductive metal as far as the front contact surface 7 of the head 5. This may be achieved for example by means of a cold deformation of the tubular body of the bush 2 in such a way as to shrink a radially outer layer of the head 5 in relation to a portion more radially inward or alternatively, by means of planing (smooth, lathing) of the radially outermost layer at the front contact surface 7.

According to a preferred embodiment, the bush 2 is composed of a multilayer tubular body (preferably double layer) having an outer layer 22 substantially made from the first conductive metal (preferably copper) and an inner layer 23 substantially made from the second conductive metal (preferably aluminium). The inner layer 23 and the outer layer 22 are connected to one another with a continuity of material substantially on the entire surface or, in other words, on the entire interface between the two layers 22, 23, for example through melting of the material in the interface or transition area between the outer layer 22 and the inner layer 23. As a result the inner layer 23 proves to all effects welded to the outer layer 22.

According to one aspect of the invention, in the interface or transition area between the two layers, the latter prove metallurgically bonded. Such metallurgical bond between the two metal layers may be achieved for example through the manufacture of the double layer or multilayer tubular body through drawing. According to one embodiment, a double layer or multilayer tube previously pre-assembled is equipped with an inner floating mandrel and is cold drawn through one or a series of outer matrices so that the high pressure between the tube layers generates the aforementioned metallurgical bond.

Alternatively, the metallurgical bond between the two metal layers can be obtained by manufacturing the double layer or multi-layer tubular body through co-extrusion or, in other words, through co-extrusion welding (CEW) in which the two different metals are, for example, extruded simultaneously and together through the same matrix so that the high pressure and the high temperature generate the metallurgical bond in the transition area 19 between the two adjacent layers of the tube.

According to a further aspect of the invention, the metallurgical bond between the two metal layers can be obtained through the manufacture of the double layer or multi-layer tubular body through roll welding (ROW) in which the different metals are joined during their forced passage between the lamination rollers so that the high pressure and, if foreseen, the high temperature generate the metallurgical bond between the layers of the tube.

In technical jargon the connection between the two layers thus obtained, that is to say the metallurgical bond of the two different metal materials, is sometimes called "metallurgical cladding". This connection is obtained through layers having preferably uniform thicknesses and not too thin and provides, together with minimum thicknesses of the metal layers involved of at least 0.3 mm, preferably from 0.3 mm to 10 mm, the most favourable mechanical and galvanic characteristics for the contact bush 2.

According to one embodiment, the tubular body which the bush 2 can be made of is a double layer tubular body with the inner layer 23 made of aluminium and the outer layer 22 made of copper, in which the inner layer 23 has a thickness ranging from 60% to 95% (preferably 75% to 80%) of the total thickness and the outer layer 22 has a thickness ranging from 5% to 40% (preferably 20% to 25%) of the total thickness of the tubular wall.

In the present invention the term "metallurgical bond" is understood to mean that the lattice structure of the two metals is forced in mutual conformance with sharing of electrons in the interface between the two layers which generates a bond at the atomic level.

Advantageously, in the interface (transition area) between the two layers, the latter prove metallurgically bonded and locally interpenetrated.

According to a further aspect of the invention, the contact bush 2 is manufactured starting from a multilayer, preferably double layer tube, cut into sections 24 of a suitable length which subsequently undergo shaping by cold deformation, moulded on an automatic press, without any need of chip removing machining.

More specifically a mould 25 is provided which defines an axial channel 26 ending at the top in a widening 27. A matched mould 28 is placed in the axial channel 26 which acts as a support element for the axial end of the section 24. A shaping punch 29 with a shaping stem 30 connected to a shoulder 32 by means of an intermediate truncated cone shaped widening portion 31 is introduced to perform the cold deformation by means of the automatic press.

The shaping stem 30 is inserted in the through hole of the section of multilayer tube 24 and the truncated cone shaped widening portion 31 forms a flaring (the aforementioned widening 9) at the flange-shaped head 5 which is delimited between the upper widening 27 of the mould 25 and the shoulder 32 of the shaping punch 29.

Once the cold deformation is completed, the matched mould 28 is operated so as to expel the multi-layer bush 2 from the mould 25.

The bush 2 made by cold deformation has a very high level of dimensional precision, an even finish and the bi-material feature with the arrangement of the first conductive material (outer layer 22) and of the second conductive metal (inner layer 23) in the desired areas previously described.

To further improve the desired mechanical characteristics, in particular those of the outer layer 22 intended to come into permanent and close contact with the hole 4 of the rail, the bush 2 may undergo, subsequent to the cold deformation step, a heat treatment to reduce any stresses caused by strain hardening.

From the description given, a person skilled in the art will appreciate how the permanent electrical contact 1 synergically reconciles the requirements of:

an electrical connection between two different metals, such as for example aluminium and copper, and the consequent problems of galvanic corrosion, a mechanical and electrical connection that can withstand vibrations and adverse weather conditions, a simple structure that can be manufactured on a large scale and at low cost.

Of course, a person skilled in the art may carry out further modifications and variants to the permanent electrical contact according to the present innovation so as to satisfy contingent and specific requirements, all moreover covered in the scope of protection of the invention, as defined by the following claims.

The invention claimed is:

1. Permanent electrical contact applicable to the web of rails and the like, comprising a bush in electrically conductive material having a tubular stem insertable in a hole in the web of a rail, a flanged head radially widened compared to the stem and suitable for engaging in abutment with a portion surrounding the hole, and an axial through hole in which a punch can be inserted to expand the tubular stem radially and join a radially outer surface of the stem closely with the hole, wherein at least a portion of the outer surface of the stem is substantially made of a first conductive metal and at least a portion of the flanged head is substantially made of a second conductive metal different from the first conductive metal, wherein the bush consists of a double layer tubular body having an outer layer substantially made from the first conductive metal and an inner layer substantially made from the second conductive metal, the inner layer and the outer layer of the tubular body being metallurgically bonded.

2. Electrical contact according to claim 1, wherein the flanged head forms a frontal contact surface on a side opposite the stem side, the front contact surface being made substantially from the second conductive metal.

3. Electrical contact according to claim 2, wherein the front contact surface of the bush is made without the first conductive metal.

4. Electrical contact according to claim 1, wherein the entire radially outer surface of the stem is made of the first conductive metal.

5. Electrical contact according to claim 4, wherein the abutment surface of the head opposite the contact surface is made substantially from the first conductive metal.

6. Electrical contact according to claim 1, wherein the entire head of the bush is substantially made from the second conductive metal.

7. Electrical contact according to claim 1, wherein the inner layer has a thickness ranging from 60% to 95% of the total wall thickness of the double layer tubular body, and the outer layer has a thickness ranging from 5% to 40% of the total wall thickness of the double layer tubular body.

8. Electrical contact according to claim 1, wherein the metallurgical bond between the outer layer and the inner layer is obtained by manufacturing the double layer tubular body through drawing or co-extrusion.

9. Electrical contact according to claim 1, wherein the first conductive metal is copper and the second conductive metal is aluminium.

10. Method of making an electrical contact applicable to the web of rails and the like, the electrical contact comprising a bush in electrically conductive material having a tubular stem insertable in a hole in the web of a rail, a flanged head radially widened compared to the stem and suitable for engaging in abutment with a portion surrounding the hole, and an axial through hole in which a punch can be inserted to expand the tubular stem radially and join a radially outer surface of the stem closely with the hole, wherein the bush consists of a double layer tubular body having an outer layer substantially made from the first conductive metal and an inner layer together with at least a portion of the flanged head substantially made from the second conductive metal, the method comprising the steps of:

providing a section of double layer tube having an outer layer made from a first conductive metal and an inner layer made from a second conductive metal different from the first conductive metal, the inner layer and the outer layer of the double layer tube being metallurgically bonded, inserting the section in the mould of a press, carrying out a cold deformation to shape the tubular stem and the flanged head radially widened compared to the tubular stem, wherein the outer layer of the double layer tube forms the radially outer surface of the tubular stem and the inner layer of the double layer tube forms a front contact surface of the flanged head opposite the stem.

11. Permanent electrical contact applicable to the web of rails and the like, comprising a bush in electrically conductive material having a tubular stem insertable in a hole in the web of a rail, a flanged head radially widened compared to the same and suitable for engaging in abutment with a portion surrounding the hole, and an axial through hole in which a punch can be inserted to expand the tubular stem radially and join a radially outer surface of the stem closely with the hole, wherein at least a portion of the outer surface is substantially made of a first conductive metal and at least a portion of the flanged head is substantially made of a second conductive metal different from the first conductive metal, wherein the bush consists of a tubular body made of the second conductive metal and externally coated with a layer of said first productive metal, and wherein, at the contact surface of the flanged head, the layer of the first conductive metal is removable by smoothing to expose the second conductive metal in the contact surface.

* * * * *